United States Patent [19]

Clausen

[11] 3,992,818

[45] Nov. 23, 1976

[54] APPARATUS FOR GRINDING AND POLISHING A WELDED SEAM

[75] Inventor: Jorgen Clausen, Kolding, Denmark

[73] Assignee: Elektrogeno AS, Denmark

[22] Filed: Nov. 20, 1975

[21] Appl. No.: 633,640

[52] U.S. Cl. ..... 51/3

[51] Int. Cl.[2] ..... B24B 7/00

[58] Field of Search ..... 51/3, 4; 228/125, 19, 228/22, 23

[56] References Cited

UNITED STATES PATENTS

| | | | |
|---|---|---|---|
| 862,341 | 8/1907 | Lewis | 51/3 X |
| 1,222,307 | 4/1917 | Laveck et al. | 51/3 X |
| 1,496,522 | 6/1924 | Canning | 51/3 |
| 2,062,875 | 12/1936 | Gardner | 228/125 X |
| 2,269,197 | 1/1942 | Hamilton | 51/4 X |
| 2,494,710 | 1/1950 | Knowlton | 51/4 |

*Primary Examiner*—Al Lawrence Smith
*Assistant Examiner*—Margaret Joyce
*Attorney, Agent, or Firm*—Michael, Best & Friedrich

[57] ABSTRACT

The apparatus includes a frame structure and a combination grinding and polishing mechanism mounted for horizontal travel thereon. The frame structure includes a bed for supporting welded sheets thereon with the face of the welded seam to be ground and polished facing upwardly. The grinding and polishing mechanism is mounted for horizontal travel on an overhead support beam positioned directly above the bed on which the welded sheets are positioned. The grinding mechanism is comprised of an endless grinding belt rotatably supported between a support wheel at one end where the belt contacts the welded seam and a roller at the other end. The support wheel is mounted for rotation on a pivotally mounted arm and is connected to a drive motor for driving the belt. The motor is mounted with its rotational axis in alignment with the pivot point of the arm. The grinding mechanism further includes a retract mechanism for raising and lowering the grinding belt into and out of its seam grinding position. The polishing mechanism is comprised of a polishing wheel rotatably mounted on a pivotally mounted support plate with the wheel mounted on one side of the pivotal axis of the plate and the drive motor for the wheel mounted on the other side of the pivotal axis of the plate. The grinding belt and polishing wheel are spaced apart from each other along the travel path of the overhead support structure so that both the grinding and polishing operation can be applied simultaneously to the welded seam.

25 Claims, 8 Drawing Figures

16
24
22
24
26
72
68
64
66
5
76
78
74
88
12
70
100
27
80
90
5
116
108
42
34
34
98
62
6
6
48
50
60
36
130
34
34
46
96
58
40
56
54
52
44

APPARATUS FOR GRINDING AND POLISHING A WELDED SEAM

BACKGROUND OF THE INVENTION

The present invention relates to an apparatus for grinding and polishing a seam and more specifically to apparatus for grinding and polishing a welded seam between plates of stainless steel. Prior apparatus for such grinding and polishing generally consisted of a manually manipulated grinder and a separate manually manipulated polishing mechanism. Such apparatus required at least semi-skilled labor for its operation and compared to the apparatus of the present invention required a substantially greater length of time to complete the grinding and polishing operation. The apparatus of the present invention accomplishes the grinding and polishing function rapidly and effectively with a minimum of man power and with the use of operators having lesser skills than were required with prior devices.

SUMMARY OF THE INVENTION

A seam grinding and polishing apparatus comprising a frame structure which includes a bed for supporting welded sheets thereon with the face of the welded seam to be ground and polished facing upwardly. Such frame also includes an overhead support beam extending horizontally above the bed. The grinding and polishing mechanism is mounted on an overhead support structure which is driven horizontally back and forth along the overhead support beam by a reversible drive motor. The grinding mechanism is supported by and depends from the overhead support structure and includes a movably mounted endless grinding belt, a drive motor therefor, and a retract mechanism for raising and lowering the grinding belt into and out of its seam grinding position as required. The polishing mechanism is also supported by and depends from the overhead support structure which mechanism includes a rotatably mounted polishing wheel, a drive motor therefor, and a retract mechanism for raising and lowering the polishing wheel into and out of its seam polishing position as required. The grinding belt and polishing wheel are so mounted that they will be spaced from each other along the travel path of the overhead support structure so that a grinding and polishing operation can be selectively applied to the welded seam either separately or simultaneously as determined by the operator.

DESCRIPTION OF THE PREFERRED EMBODIMENT

Figure 1:
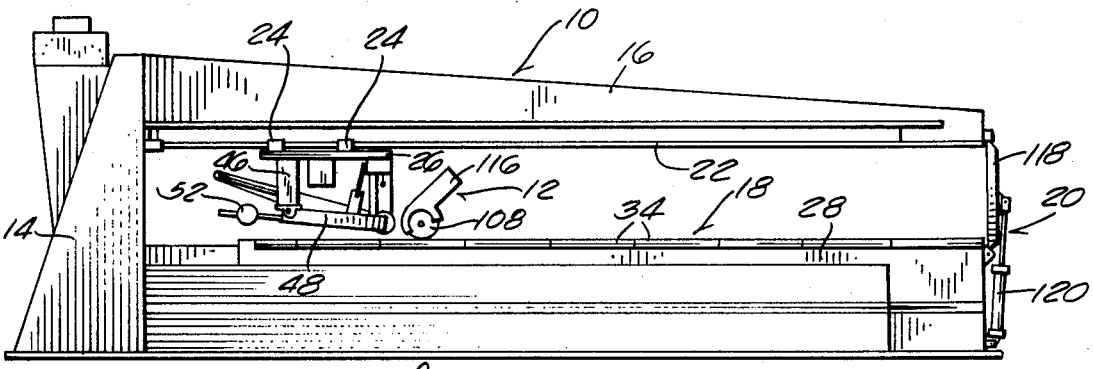
FIG. 1 is a side elevation view of the seam grinding and polishing apparatus of the present invention.

Referring to FIG. 1, the apparatus of the present invention is comprised of a frame structure 10 and a combination grinding and polishing mechanism 12 mounted for horizontal travel thereon. Frame 10 is comprised of a vertical support column 14 having a horizontally extending overhead support beam 16 mounted on the top portion thereof and a bed structure 18 extending from the bottom portion thereof directly underneath the beam 16. A retractable support mechanism 20 may be provided at the end of beam 16 (FIG. 1) the construction and function of which will be described hereinafter.

The grinding and polishing mechanism 12 is mounted for horizontal travel on support beam 16 by means of a pair of spaced rod members 22 fastened to the beam on which mechanism 12 is slidably mounted by pairs of support collars 24 and a support plate 26 welded or otherwise attached to the collars 24. The mechanism 12 is driven back and forth along beam 16 on rods 22 by any suitable means such as a rack and pinion gear mechanism (not shown) driven by a reversible electric motor 27.

Figure 6:
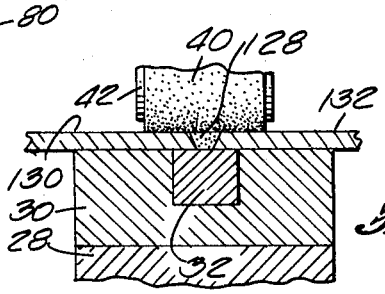
FIG. 6 is a fragmentary cross-sectional view taken along line 6—6 of FIG. 2.

Bed structure 18 is comprised of a support frame 28 and a work support member 30 mounted on the center line thereof directly beneath the overhead support beam 16. In the preferred embodiment, member 30 is made of hard wood and as best shown in FIG. 6 has a bar 32 of metal (preferably copper) embedded in the upper surface along the center line thereof. Support bed 18 is also provided with two spaced sets of rollers 34 mounted on opposite sides of hard wood member 30. Rollers 34 are preferably made from or covered with plastic material and serve to facilitate movement of the welded sheets onto and off of the support bed 18. Copper bar 32 serves to conduct heat away from the area of the welded seam as it is being ground and polished as will be described in more detail hereinafter.

Figure 3:
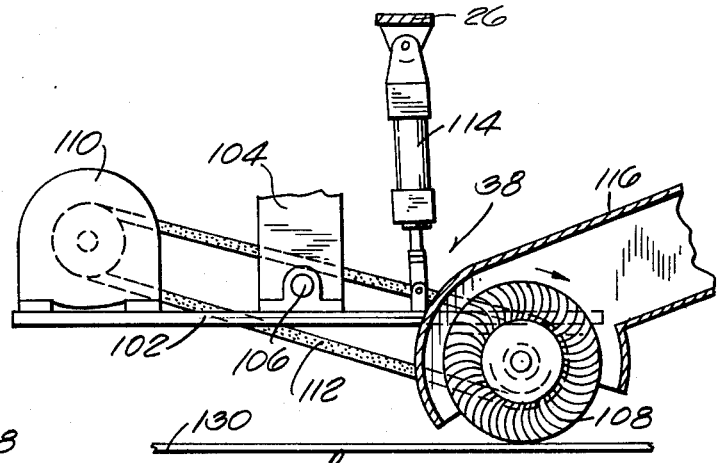
FIG. 3 is a view similar to FIG. 2 but with the grinding mechanism not shown so that the details of the polishing mechanism can be seen.
Figure 2:
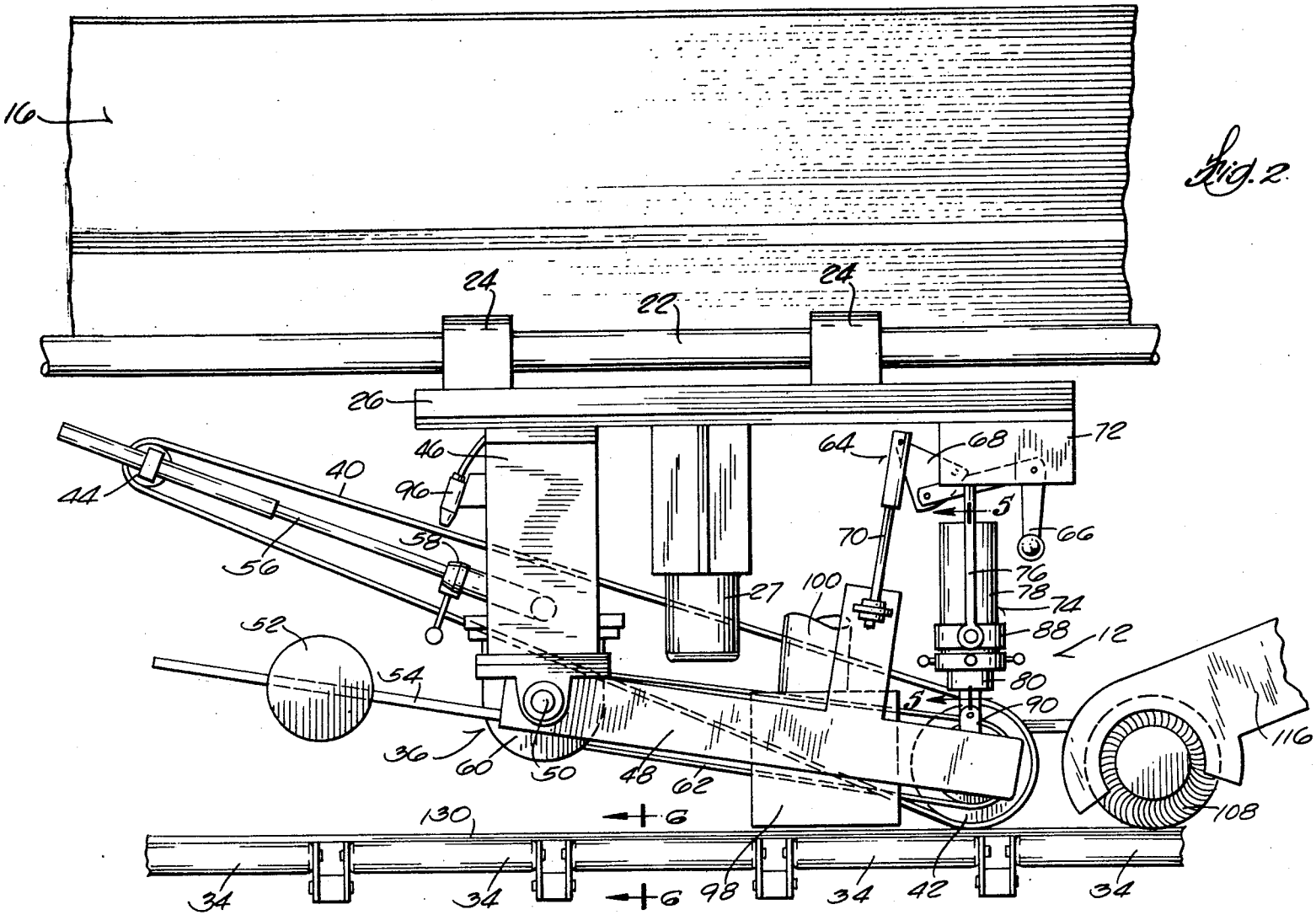
FIG. 2 is an enlarged fragmentary side elevation view of the apparatus shown in FIG. 1 showing the details of the grinding mechanism.
Figure 7:
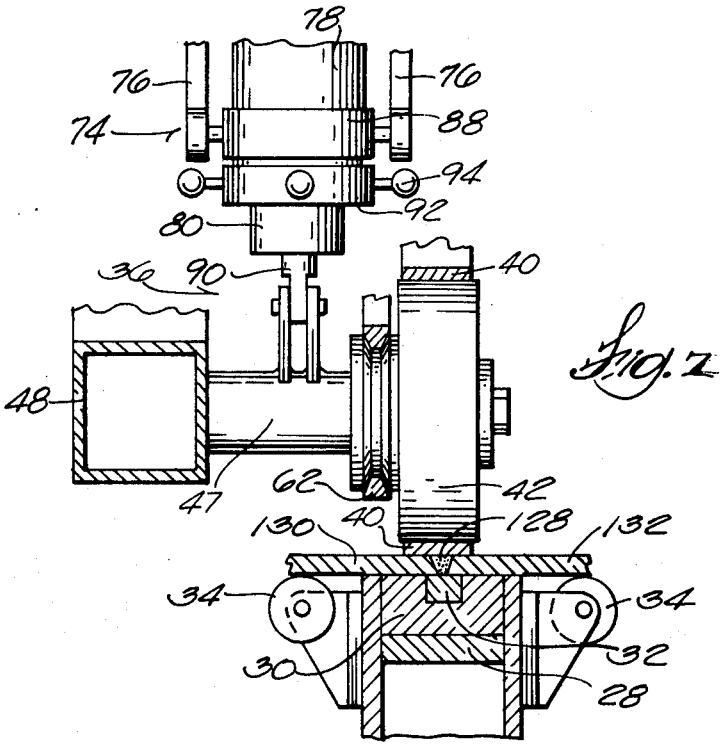
FIG. 7 is a fragmentary end elevation view of the grinding mechanism shown in FIG. 2.
Figure 8:
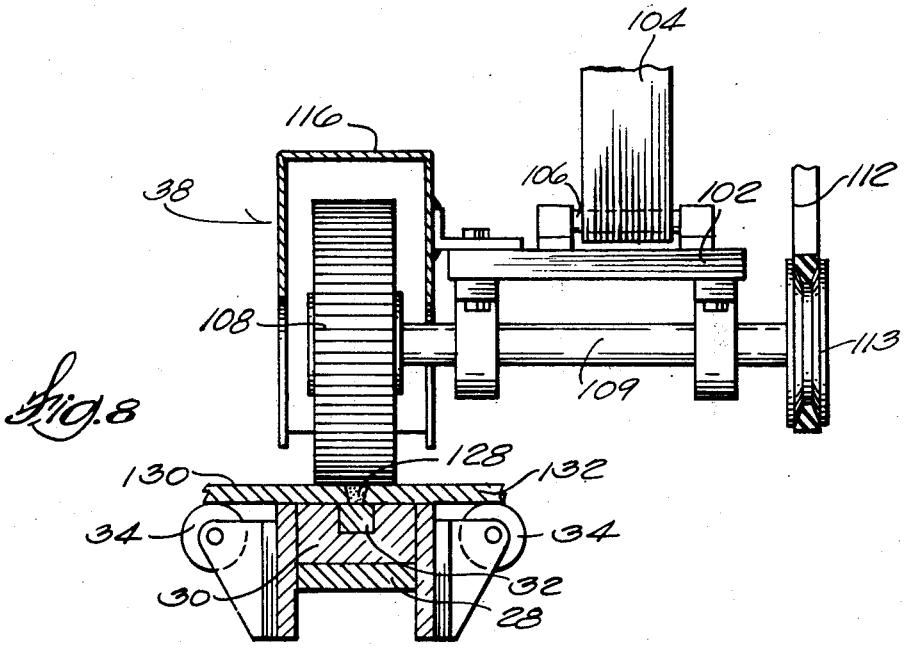
FIG. 8 is a fragmentary end elevation view of the grinding mechanism shown in FIG. 3.

Referring now to the grinding and polishing mechanism 12, such mechanism is comprised of a separate grinding mechanism 36 (FIGS. 2 and 7) and a separate polishing mechanism 38 (FIGS. 3 and 8). Grinding mechanism 38 is comprised of an endless grinding belt 40 rotatably mounted at one end on a wheel 42 and at the other end on a roller 44. The entire grinding mechanism is mounted on a column member 46 fastened to and depending from the lower face of support plate 26. Wheel 42 is rotatable mounted on a shaft 47 fastened to the end of an arm 48 which arm is pivotally supported on the lower end of column 46 by a shaft 50. An adjustable counterweight 52 is mounted on a rod structure 54 fastened to the end of arm 48 which rod structure in effect acts as an extension of the arm 48.

Roller 44 is rotatably mounted on a rod member 56 fixedly fastened to column 46. The effective length of rod member 56 can be adjusted by an adjustment mechanism 58 (of conventional design) to facilitate replacement of grinding belt 40 and the adjustment of the operational tension of the belt. Roller 44 is laterally adjustable, and is used for "centering" the grinding belt. Belt 40 is of conventional design comprised of flexible backing material having a suitable abrasive material adhered to one surface thereof.

Belt 40 is driven by an electric motor 60 mounted on column 46 with the axis of the motor in alignment with the axis of shaft 50. The output shaft of motor 50 is drivingly connected to wheel 42 by a belt 62.

Grinding belt support wheel 42 is shifted between its seam grinding position (FIG. 2) and its retracted position by means of a manually actuated mechanism 64 comprised of a crank handle 66, a link member 68 and a connecting rod 70. Handle 66 is pivotally mounted on a bracket 72 fastened to support plate 26 and is pivotally connected to link 68 which in turn is pivotally connected to the upper end of rod 70. The lower end of rod 70 is adjustably connected to the arm 48. To raise wheel 42 from its grinding position (FIG. 2) to its retracted position handle 66 is pivoted in a clockwise direction as viewed in FIG. 2.

Figure 5:
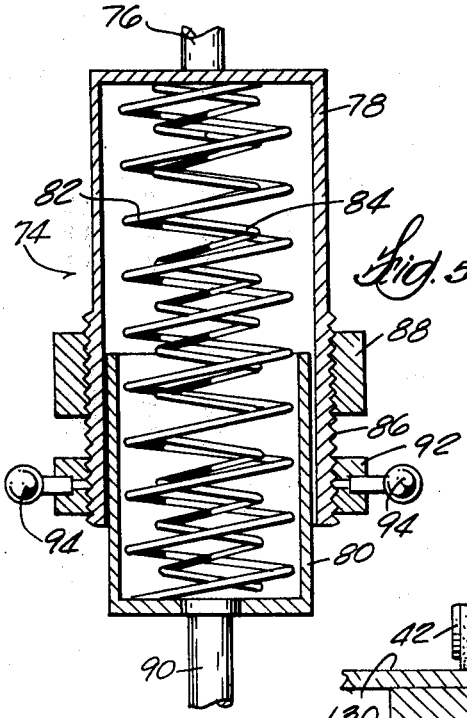
FIG. 5 is a fragmentary cross-sectional view taken along line 5—5 of FIG. 2.

To maintain the grinding belt 40 in substantially constant pressure contact with the welded seam to be ground and polished a biasing mechanism 74 is provided. As best shown in FIG. 5, mechanism 74 is supported from above by a pair of support rod members 76 fastened to support plate 26. Mechanism 74 is comprised of a pair of telescopically engaged cylindrical body members 78, 80 and a pair of counterwound springs 82, 84 mounted therein. Body member 78 is externally threaded, as indicated by reference numeral 86, and an adjustment collar member 88 is threaded thereon. The lower ends of support rod members 76 are pivotally connected to collar 88 and the mechanism 74 is operatively connected to arm 48 by a rod 90 connected at its upper end to body member 80 and at its lower end to shaft 47.

A second collar member 92 equipped with handles 94 is fastened to the lower end of body member 78. To adjust the biasing force exerted on the wheel 42 and belt 40 by mechanism 74, body member 78 is rotated relative to collar 88 by means of handles 94 on collar 92. Such relative rotation will cause the telescopically engaged body members 78 and 80 to slide into and out of engagement with each other, to thereby vary the effective length of springs 82, 84, which in turn will vary the biasing force exerted by mechanism 74 on the arm 48. Counterwound springs 82, 84 are designed so that small variations in the effective length thereof, due for example to unevenness of the welded seam to be ground and polished, will result in only a very small variation in the biasing force exerted so that for any given adjustment setting of mechanism 74, a substantially constant pressure at the grinding area will result.

A nozzle 96 connected to a source of air under pressure (not shown) is positioned adjacent the face of grinding belt 40 to provide a stream of cooling fluid to the belt 40 and thereby prolong its useful life.

A hood structure 98 and a conduit 100 connected to a suitable exhaust fan and dust collector means (not shown) is provided adjacent grinding wheel 42 to remove particles of metal and abrasive material from the grinding area.

Referring now to the polishing mechanism 38, as best shown in FIGS. 3 and 8, such mechanism is comprised of a support plate 102 pivotally mounted on a vertical support column 104 by a shaft 106. Column 104 is fastened at its upper end to support plate 26. A polishing wheel 108 is mounted on a shaft 109 which in turn is journaled in bearing 111 mounted on one end of plate 102. Mounted on the other end of the plate is a drive motor 110. Motor 110 is drivingly connected to wheel 108 by a belt 112 and a pulley 113. It will be appreciated that by mounting drive motor 110 on the opposite side of the pivot point of plate 102 from polishing wheel 108 motor 110 will serve as a counterweight for the wheel. Polishing wheel 108 may be of any suitable design. In the preferred embodiment wheel 108 is of a flapper-wheel type construction comprised of a plurality of sheets of refractory material mounted on the central core so that as the wheel rotates (in the direction indicated by the arrow on FIG. 3) the individual sheets of refractory material will wipe against the surface to be polished.

Plate 102 and polishing wheel 108 mounted thereon are pivoted from the wheel's operative position as shown in FIG. 3 to its retracted position by means of a double acting pneumatic power cylinder 114 pivotally connected at its upper end to a bracket on support bed 26 and at its lower end to plate 102. Cylinder 114 is operated to raise and lower polishing wheel 108 by any suitable control means (not shown) positioned at a convenient location.

Polishing mechanism 38 is also provided with a hood structure 116 mounted over polishing wheel 108. The hood structure is connected to a suitable exhaust fan and dust collector (not shown) to remove particles of metal and abrasive material from the polishing area.

Figure 4:
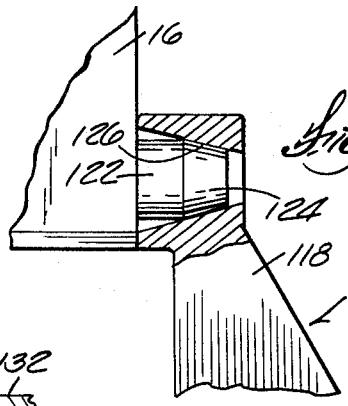
FIG. 4 is an enlarged fragmentary view (with parts broken away) of the retractable support mechanism at the end of the frame as shown in FIG. 1.

The retractable support mechanism 20 (FIGS. 1 and 4) is comprised of a support arm 118 pivotally mounted at the end of support frame 28 of bed structure 18. Arm 118 is pivoted between its support position as shown in FIG. 1 and its retracted position (not shown) by a pneumatic power cylinder 120 pivotally connected at its lower end to the base of support frame 28 and at its upper end to the arm 118. As best shown in FIG. 4, engagement between arm 118 and the end of overhead beam 16 is provided by a pin 122 on the end of the beam which pin has a conical tip portion 24 adapted for engagement in a conical cavity 126 formed in the upper end of arm 118. With this arrangement any slight downward flexure of the end of beam 16 when arm 18 is retracted will be accommodated upon return of the arm by the conical pin and cavity combination.

OPERATION

The apparatus of the present invention is particularly designed for grinding and polishing welded seams between relatively large sheets of metal (usually stainless steel). For example, it is contemplated that the length of frame section 10 of the machine would be in the range of 3–7 meters depending upon individual requirements with a maximum effective grinding length of 6 meters (with a 7 meter frame).

The frame 10 equipped with the retractable support mechanism 20 is capable of handling both flat and curved welded sheets. To grind a welded seam between a pair of flat sheets the sheets are inserted from the side of the unit with the rollers 34 serving to facilitate the positioning of the sheets in the machine. To grind a welded seam between a pair of curved sheets for fabricating a cylindrical tank, for example, support arm 118 can be actuated to its retracted position by cylinder 120 to open up the end of the machine. The curved sheets can then be inserted from the end of the machine.

For purposes of explaining the operation of the apparatus of this invention, it will be assumed that a butt-welded seam 128 between a pair of flat plates 130, 132 (FIG. 6) is to be ground and polished.

The first step is to position plates 130, 132 on bed structure 118 with welded seam 128 located directly above metal bar member 32 as shown in FIG. 6. As indicated previously, this can be accomplished by simply sliding the welded plates onto bed 18 from either side of the machine, it not being necessary to retract support arm 118.

The subsequent procedure for welding and polishing seam 128 will vary somewhat depending on the condition of the seam but in a typical example the grinding and polishing mechanism 12 of the machine is initially positioned at the left hand end of frame 10 as viewed in FIG. 1, such position being a sufficient distance towards the extreme left end of the frame so that grinding belt support wheel 42 will be positioned directly above the end of seam 128.

Grinding belt drive motor 60 is energized and the grinding mechanism 12 is lowered to its operative position by manual actuation of handle 66. Power cylinder 114 of the polishing mechanism is actuated to raise polishing wheel 108 to its retracted position. Drive motor 27 is then energized to drive mechanism 12 on support rods 22 along beam 16 to the right as viewed in FIG. 1. As the mechanism 12 travels to the right, as described above, the welded seam 28 will be ground by belt 40 in a continuous and uniform manner. As explained previously the contact pressure between belt 40 and seam 28 can be adjusted and then uniformly maintained by means of biasing mechanism 74.

It should be noted at this point that by mounting drive motor 60 with its drive axis in alignment with the axis of the pivot point of arm 48, the tension in drive belt 62 will remain constant throughout any pivotal movement of arm 48 due to surface variations in the welded seam to be ground or due to the movement of the grinding belt mounting wheel between its retracted and operative positions by actuation of handle 66.

It is also noted that spacing mounting roller 44 and mounting wheel 42 a relatively long distance apart (on opposite sides of support column 46), a relatively long grinding belt 40 can be employed. By the use of a relatively long grinding belt the overall useful life of the belt will be extended accordingly. The extra long length of the belt and the use of a cooling air nozzle 96 for directing a flow of cooling air onto the working face of the belt results in cooler operating belt temperatures to thereby further extend the useful life of the belt.

When the grinding mechanism reaches the right hand end of seam 128, the unit is stopped by the operator by deenergization of motor 27, the polishing wheel 108 is then lowered to its operative position by energization of power cylinder 114. The polishing wheel drive motor 110 is then started and the entire unit is driven back to the left as viewed in FIG. 1 by energization of motor 27 in its reverse direction. During this second pass of the grinding and polishing mechanism over the welded seam, grinding belt 40 will continue to apply a grinding action to the seam and the polishing wheel which is positioned to the right of the grinding belt will provide a simultaneous polishing action to the ground seam. Normally a two-pass operation as described above will be sufficient to properly grind and polish the seam, in which event when the mechanism reaches the left hand end of the seam, it is stopped, the grinding belt and polishing wheel are retracted, the finished sheets are removed and a second set of welded plates are inserted onto the machine.

It will be appreciated that if the weld is particularly rough, subsequent passes of the grinding and polishing mechanism can be made until the seam reaches its desired condition. It will also be appreciated that if the seam is of particularly high quality before grinding and polishing, it may be necessary to use only the polishing wheel 108 on the return pass from right to left.

It will be appreciated from the above description that the apparatus of the present invention provides an extremely flexible arrangement for grinding and polishing seams of varying quality and accomplishes such grinding and polishing rapidly and effectively with a minimum of manpower required. Furthermore, the expertise required by the operator is considerably less than in prior less automated constructions, making it possible to use operators with lesser skills than would otherwise be the case.

I claim:

1. A seam grinding and polishing apparatus comprising:

a frame structure including a bed structure for supporting welded sheets thereon with the face of the welded seam to be ground and polished facing upwardly, said frame structure further including an overhead support beam extending horizontally above said bed structure;

a grinding and polishing mechanism overhead support structure mounted for horizontal travel along said overhead support beam including a drive means for driving said support structure back and forth on said beam;

a grinding mechanism supported by and depending from said overhead support structure, said grinding mechanism including, a movably mounted endless grinding belt, a drive motor and thereof and a retract mechanism for raising and lowering said grinding belt into and out of its seam grinding position; and a polishing mechanism supported by and depending from said overhead support structure, said polishing mechanism including a rotatably mounted polishing wheel, a drive motor therefor and a retract mechanism for raising and lowering said polishing wheel into and out of its seam polishing position, said grinding belt and polishing wheel spaced apart from each other along the travel path of said overhead support structure so that both a grinding and polishing operation can be applied simultaneously to the welded seam.

2. A seam grinding and polishing apparatus according to claim 1 in which said grinding mechanism further includes a pivotally mounted support arm structure having a grinding belt support wheel rotatably mounted on one end thereof on which one end of said endless grinding belt is mounted and with said grinding belt drive motor mounted with its drive axis in alignment with the pivotal axis of said pivotally mounted support arm.

3. A seam grinding and polishing apparatus according to claim 2 in which there is an adjustable counterweight mounted on the other end of said pivotally mounted support arm from that on which said grinding belt support wheel is mounted.

4. A seam grinding and polishing apparatus according to claim 2 in which said grinding mechanism further includes a roller member on which the other end of said endless grinding belt is mounted, said roller member being rotatably mounted at a location spaced from said pivot point of said support arm in a direction opposite from that of which said grinding belt mounting wheel is mounted.

5. A seam grinding and polishing apparatus according to claim 4 in which said roller member is mounted on rod member of adjustable length so that the distance between the axis of said grinding belt support wheel and the axis of said roller member can be adjusted.

6. A seam grinding and polishing apparatus according to claim 2 in which said grinding mechanism further includes a biasing means operatively connected to said pivotally mounted support arm structure, said biasing means adapted to provide a substantially constant pressure between said grinding belt and the welded seam when said grinding belt is in its seam grinding position.

7. A seam grinding and polishing apparatus according to claim 6 in which said biasing means is comprised of a pair of telescopically engaged body members having a pair of counterwound spring members mounted therein.

8. A seam grinding and polishing apparatus according to claim 1 in which said polishing mechanism further includes a pivotally mounted support arm having said polishing wheel mounted on one side of the pivot point of the arm and said drive motor mounted on the other side of the pivot point of the arm so that said drive motor will serve as a counterweight for said polishing wheel.

9. A seam grinding and polishing apparatus according to claim 8 in which said retract mechanism for raising and lowering said polishing wheel into and out of its seam polishing position includes a double acting power cylinder operatively connected to said pivotally mounted support arm on which said polishing wheel is mounted.

10. A seam grinding and polishing apparatus according to claim 1 in which said frame structure includes a retractable support mechanism mounted at one end of said bed structure for movement between a support position wherein it serves to support one end of said overhead support beam and a retract position wherein the space between the ends of said overhead beam and said support bed is left open to facilitate placement of welded sheets on said bed structure from the open end of said apparatus.

11. A seam grinding and polishing apparatus according to claim 1 in which said bed structure includes a horizontally extending support surface upon which the welded sheets are supported during the grinding and polishing operation, said support surface including a member of non-metallic material having an elongated bar of metal embedded in the surface thereof and extending horizontally beneath the welded seam to be ground and polished.

12. A seam grinding and polishing apparatus according to claim 11 in which said bed structure further includes a plurality of roller members mounted on opposite sides of said non-metallic member to facilitate movement of the welded sheets onto and off of the bed structure.

13. A seam grinding and polishing apparatus according to claim 12 in which said non-metallic member is made of hard wood and said bar of metal is made of copper.

14. A seam grinding and polishing apparatus according to claim 1 in which said grinding mechanism further includes a cooling means for cooling said endless grinding belt, said cooling means including a nozzle means for directing a flow of cooling fluid on to said belt.

15. A seam grinding and polishing apparatus comprising:

a frame structure including a bed structure for supporting welded sheets thereon with the face of the welded seam to be ground and polished facing upwardly, said frame structure further including an overhead support beam extending horizontally above said bed structure;

an overhead support structure mounted for horizontal travel along said overhead support beam including a drive means for driving said support structure back and forth on said beam;

a grinding mechanism supported by and depending from said overhead support structure, said grinding mechanism including a movably mounted endless grinding belt, a drive motor therefor and a retract mechanism for raising and lowering said grinding belt into and out of its seam grinding position, said grinding mechanism further including a vertical support column fastened to said overhead support structure and a support arm structure pivotally mounted on said vertical support column, said support arm having a grinding belt support wheel rotatably mounted on one end thereof on which one end of said endless grinding belt is mounted, said grinding belt drive motor mounted on said vertical support column with its drive axis in alignment with the pivotal axis of said pivotally mounted support arm.

16. A seam grinding and polishing apparatus according to claim 15 in which there is an adjustable counterweight mounted on the other end of said pivotally mounted support arm from that on which said grinding belt support wheel is mounted.

17. A seam grinding and polishing apparatus according to claim 15 in which said grinding mechanism further includes a roller member on which the other end of said endless grinding belt is mounted, said roller member being rotatably mounted at a location spaced from said pivot point of said support arm in a direction opposite from that of which said grinding belt mounting wheel is mounted.

18. A seam grinding and polishing apparatus according to claim 17 in which said roller member is mounted on rod member of adjustable length so that the distance between the axis of said grinding belt support wheel and the axis of said roller member can be adjusted.

19. A seam grinding and polishing apparatus according to claim 15 in which said grinding mechanism further includes a biasing means operatively connected to said pivotally mounted support arm structure, said biasing means adapted to provide a substantially constant pressure between said grinding belt and the welded seam when said grinding belt is in its seam grinding position.

20. A seam grinding and polishing apparatus according to claim 19 in which said biasing means is comprised of a pair of telescopically engaged body members having a pair of counterwound spring members mounted therein.

21. A seam grinding and polishing apparatus according to claim 15 in which said frame structure includes a retractable support mechanism mounted at one end of said bed structure for movement between a support position wherein it serves to support one end of said overhead support beam and a retract position wherein the space between the ends of said overhead beam and said support bed is left open to facilitate placement of welded sheets on said bed structure from the open end of said apparatus.

22. A seam grinding and polishing apparatus according to claim 15 in which said bed structure includes a horizontally extending support surface upon which the welded sheets are supported during the grinding and polishing operation, said support surface including a member of non-metallic material having an elongated bar of metal embedded in the surface thereof and extending horizontally beneath the welded seam to be ground and polished.

23. A seam grinding and polishing apparatus according to claim 22 in which said bed structure further includes a plurality of roller members mounted on opposite sides of said non-metallic member to facilitate movement of the welded sheets onto and off of the bed structure.

24. A seam grinding and polishing apparatus according to claim 23 in which said non-metallic member is made of hard wood and said bar of metal is made of copper.

25. A seam grinding and polishing apparatus according to claim 14 in which said grinding mechanism further includes a cooling means for cooling said endless grinding belt, said cooling means including a nozzle means for directing a flow of cooling fluid on to said belt.

* * * * *

PO-1050
(5/69)

UNITED STATES PATENT OFFICE
CERTIFICATE OF CORRECTION

Patent No. 3,992,818 Dated November 23, 1976

Inventor(s) Jorgen Clausen

It is certified that error appears in the above-identified patent and that said Letters Patent are hereby corrected as shown below:

IN THE CLAIMS

Column 6, line 35, after "motor" delete "and thereof" and insert --therefor--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*